United States Patent [19]

Kanda et al.

[11] Patent Number: 4,670,953

[45] Date of Patent: Jun. 9, 1987

[54] METHOD FOR FORMING WARP BEAM OF UNIFORM DIAMETER

[75] Inventors: Hisashi Kanda; Susumu Nario; Kazuhiko Morifuji; Yuzo Kawada; Takashi Sakai; Takeshi Kawada; Katsura Shimada; Mitsuo Tsuneda, all of Toyama, Japan

[73] Assignees: Mitsubishi Acetate Co. Ltd.; Mitsubishi Rayon Company, Ltd., both of Tokyo, Japan

[21] Appl. No.: 773,058

[22] Filed: Sep. 6, 1985

[30] Foreign Application Priority Data

Sep. 10, 1984 [JP] Japan ..... 59-189095

[51] Int. Cl.[4] ..... D02H 5/00

[52] U.S. Cl. ..... 28/185

[58] Field of Search ..... 28/185; 364/470

[56] References Cited

U.S. PATENT DOCUMENTS

| | | | |
|---|---|---|---|
| 3,174,207 | 3/1965 | Duncan et al. | 28/185 |
| 3,382,352 | 5/1968 | Yetter | 28/185 X |
| 3,421,193 | 1/1969 | Taylor | 28/172 |
| 3,440,700 | 4/1969 | Berridge | 28/185 |
| 3,461,518 | 8/1969 | Stelwagen et al. | 28/185 |
| 3,991,448 | 11/1976 | Kracke et al. . | |
| 4,137,614 | 2/1979 | Wolstencroft | 28/172 |
| 4,326,322 | 4/1982 | Gaiser | 28/194 X |

FOREIGN PATENT DOCUMENTS

| | | |
|---|---|---|
| 0023583 | 11/1981 | European Pat. Off. . |
| 56-34661 | 8/1981 | Japan . |
| 56-34662 | 8/1981 | Japan . |

*Primary Examiner*—Robert R. Mackey

*Attorney, Agent, or Firm*—Oblon, Fisher, Spivak, McClelland & Maier

[57] ABSTRACT

A method and device for forming a warp beam of uniform diameter by feedback control of winding tension, in which a signal obtained from local winding tensions, each corresponding to a tension of a yarn at a certain widthwise position, are utilized for adjusting the position and width of a reed so that distribution of the warp on the beam is improved and an intra-beam diameter difference is compensated. One of the signals obtained from the local winding tensions is utilized for adjusting the rotational speed of rollers so that an inter-beam diameter difference is compensated. Thus, a warp beam without intra- or inter-beam diameter difference can always be produced.

5 Claims, 3 Drawing Figures

METHOD FOR FORMING WARP BEAM OF UNIFORM DIAMETER

BACKGROUND OF THE INVENTION

1. Field of the Invention

The present invention relates to warp beaming for a warp knitting machine or a loom, especially to a method for forming a warp beam of uniform diameter, even in a selvage portion while controlling winding tension of a warp.

2. Description of the Related Art

In a conventional warp knitting machine, a predetermined number of warp beams are fixedly held on one common shaft to form an integrated single warp beam. A sheet consisting of a plurality of parallel warps is withdrawn therefrom by rotation of the shaft for a knitting operation. If the warp beams are different in diameter (i.e., "inter-beam diameter difference") or if a single beam has differences in diameter (i.e., "intra-beam diameter difference"), the tension of the warp in the sheet tends to vary along the width of the sheet. The difference of the tension causes a wale streak in the resultant fabric. A similar drawback occurs in a loom for producing a woven fabric. Therefore, it has been desired for a long time to provide a method and apparatus for obtaining warp beams of a uniform diameter even in a selvage portion.

Especially, since a barrel 31 on which the beam is formed has tapered flanges 32 at opposite ends thereof, as shown in FIG. 3, the local diameter of the beam (i.e., a diameter of the beam at a certain widthwise position) at the selvage portions tends to be irregular relative to the middle portion of the beam, because the distance between the flanges 32 increases the further out from the barrel. In the prior art, to avoid this intra-beam diameter difference, local diameters of various portions of the beam on the warper are frequently inspected during the winding operation by stopping the machine. If there is a certain difference between measured diameters, a width and/or a position of a reed is adjusted to compensate for the distribution of the warp on the beam. It is apparent that this method is very cumbersome and lowers productivity.

In Japanese Examined Patent Publication (Kokoku) No. 56-34661, to avoid an inter-beam diameter difference, a correlation coefficient is calculated from an accumulated warp length already wound on a beam and accumulated revolutions of the beam corresponding thereto and is compared to a predetermined reference correlation coefficient, whereby the total winding tension is controlled to compensate for the beam diameter. Also in Japanese Examined Patent Publication (Kokoku) No. 56-34662, a correlation coefficient is calculated from a rotational rate of a warp beam and a winding speed of warp and is compared to a predetermined reference correlation coefficient, whereby the total winding tension is controlled to compensate for the beam diameter. These methods, however, are effective only for inter-beam diameter differences and cannot improve the intra-beam diameter difference.

SUMMARY OF THE INVENTION

Thus, it is an object of the present invention to improve the intra- and/or inter-beam diameter difference based on a principle that the winding tension of the warp varies corresponding to the beam diameter.

It is another object of the present invention to provide a method for achieving a uniform intra- and/or inter-beam diameter of warp beams by utilizing the abovesaid correspondence of winding tension and beam diameter.

The objects of the present invention are achievable by a method for forming a warp beam of uniform diameter in a warper, while guiding warps or warp yarns by a reed, including the steps of continuously measuring a local winding tension of warps at a plurality of portions of a warp sheet to be wound on the warp beam, including opposite side portions thereof;

judging whether there is an intra-beam diameter difference from the measured local tension values and, if existing, generating a control signal; and automatically adjusting a position and/or a width (i.e. geometric parameter) of the reed in accordance with the control signal to improve the warp distribution on the beam and compensate for the intra-beam diameter difference on the beam.

The local winding tension is preferably measured at a middle portion of the warp sheet besides the opposite side portions. The intra-beam diameter difference on the beam is judged by using, as a reference, a value obtained from the middle portion.

The abovesaid method preferably further includes a step of avoiding damage of the warp due to an excessive winding tension in the upstream region.

Further, the local winding tension of the middle portion warp may be controlled to follow a predetermined time schedule pattern by use of a control signal indicative of a difference between the pattern tension value and the reference tension value.

The abovesaid method according to the present invention is preferably carried out by a device for forming a warp beam of uniform diameter in a warper, while guiding warps by a reed, including means for measuring a local winding tension at a plurality of widthwise portions of a warp sheet to be wound on the warp beam, including opposite side portions thereof; means for processing the measured values of the local winding tension and generating a control signal for adjusting a width and/or a position of the reed; and means for adjusting the reed in accordance with the control signal.

The abovesaid device may further include means for adjusting a local winding tension of the middle portion warps, means for adjusting a winding speed of the warps and means for a imposing a time schedule of a predetermined winding to be fed to the processing means.

BRIEF DESCRIPTION OF THE DRAWINGS

Other objects and advantages of the present invention will be apparent from the following description with reference to the drawings, illustrating preferable embodiments of the present invention, wherein.

DESCRIPTION OF THE PREFERRED EMBODIMENTS

Figure 1:
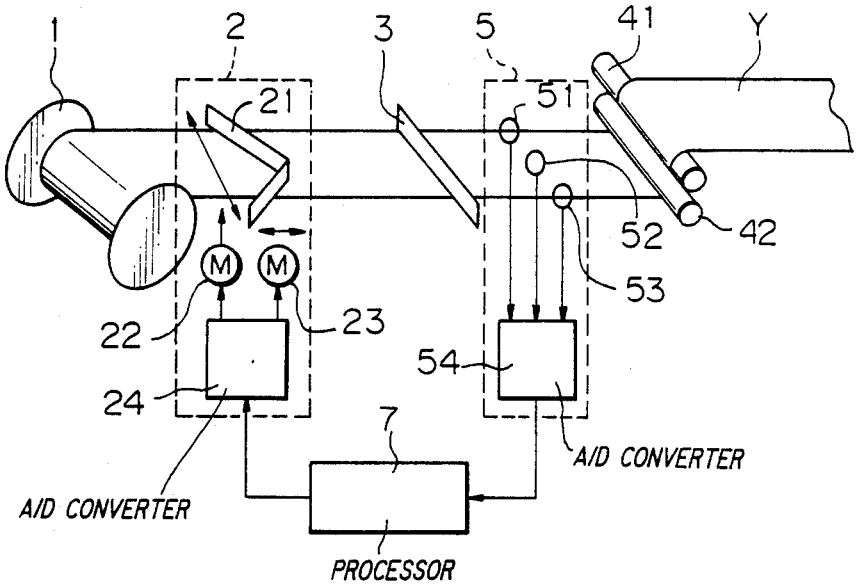
FIG. 1 is a diagrammatic perspective view of a first embodiment of a device according to the present invention.
Figure 3:
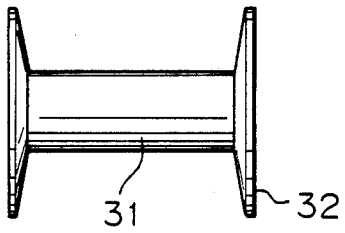
Fig. 3 PRIOR ART
FIG. 3 is a side view of a barrel of a warp beam, illustrating a tapered flange portion thereof.

Main parts of a device according to a first embodiment are shown in FIG. 1, in which warps Y are fed in a sheet form from the right and wound on a positively driven warp beam 1. Midway of the passage, the warps Y pass through a gap between a front roller 41 and a measuring roller 42; a group of sensors 51, 52, 53, provided at one side portion, a middle portion, and the other side portion of the width of the warp sheet for detecting a local winding tension, i.e., a tension of a yarn at a given widthwise position; a middle reed 3; and a front reed 21. The sensor group constitutes a local tension measuring part 5 together with an analog to digital (A/D) converter 54. The front reed 21 constitutes a reed adjusting part 2 in combination with motors 22, 23 and an A/D converter 24. The front reed 21 is adjustable in its widthwise position and its width by means of the motors 22 and 23.

The local tensions measured by the sensors 51, 52, and 53 are converted through the A/D converter 54 to digital signals and input to a processor 7, in which the signals are compared to each other and whereby the degree of the intra-beam diameter difference on the beam now being formed is judged. From the result, if control of the beam diameter is required, a signal is directed from the processor 7 for driving the motors 22 and 23 to adjust the position and width of the front reed 21 for compensating for the widthwise irregularity of beam diameter.

Figure 2:
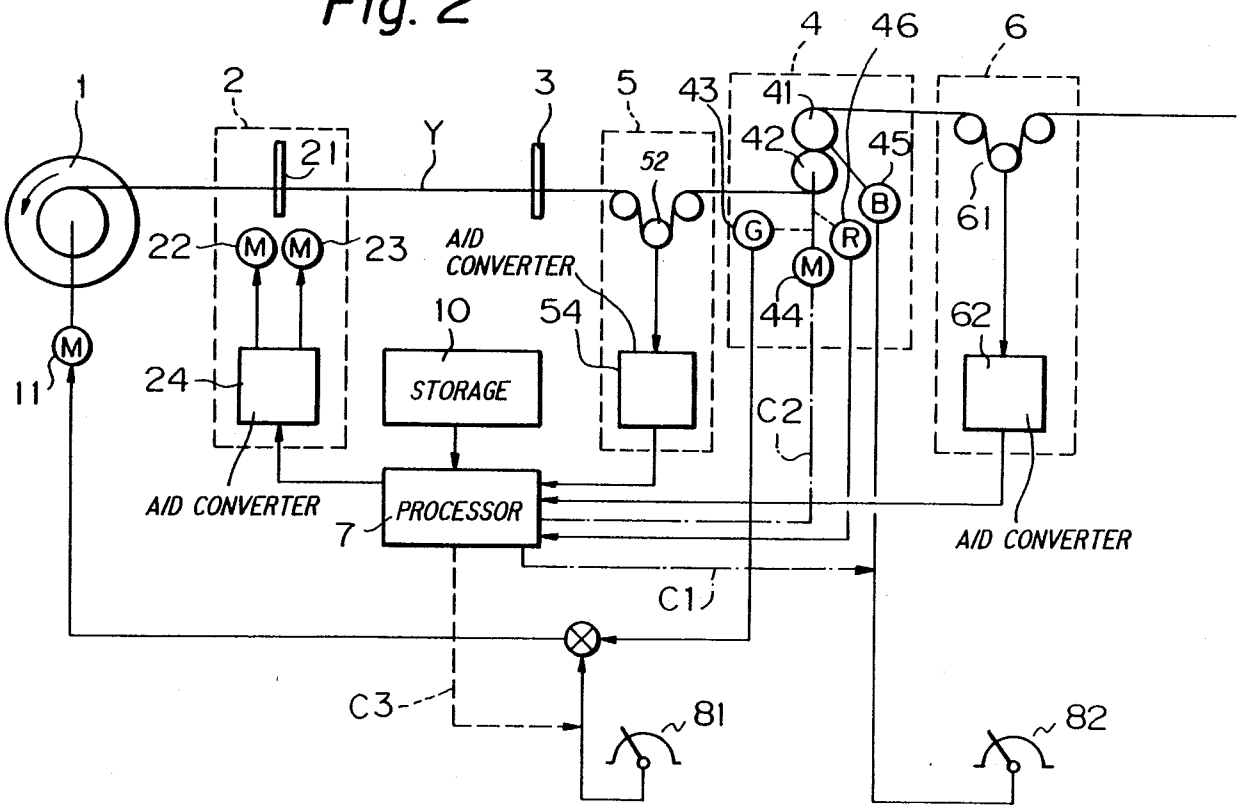
FIG. 2 is a block diagram of a second embodiment of a device according to the present invention.

In a second embodiment of a device according to the present invention shown in FIG. 2, further parts are added for achieving a more improved compensation of diameter difference of the beam, especially the inter-beam diameter difference. In FIG. 2, the rotational speed of the warp beam 1 is controlled to be a constant value by comparing a voltage V1 preliminarily set in a yarn speed setter 81 and a voltage V2 output from a tacho generator 43 for detecting a yarn speed connected to the measuring roller 42 and by adjusting a voltage to be fed to a beam driving DC motor 11 so that a difference between the voltages V1 and V2 is eliminated.

An excessive winding tension measuring part 6 is provided upstream of the front roller 41 for detecting a winding tension of the warps Y between a creel of a warp source (not shown) and the front roller 41 including a tension sensor 61 and an A/D converter 62 for receiving a signal from the former and transmitting it to the processor 7 while converting the signal to a digital form. A tension regulating part 4 is provided in connection with the front roller 41 and the measuring roller 42 just downstream of the tension measuring part 6, wherein an electromagnetic brake 45 of a powder type controlled by the setter 82 for braking the front roller 41 to increase warp tension between the beam 1 and the front roller 41, a motor 44 for positively driving the measuring roller 42 to decrease warp tension between the beam 1 and the front roller 41, and a counter 46 for measuring the number of revolutions of the measuring roller 42 are provided.

According to the above arrangement, if an upstream winding tension exceeding a value preset in a storage 10 is detected by the tension measuring part 6, the rotational speed of the motor 44 is decreased to some extent or, in an extreme case, reduced so that damage of the warps can be avoided. In addition, the preset voltage in the yarn speed setter 81 is changed so that the rotational rate of the beam is decreased.

On the other hand, the local winding tension of the middle portion of the warp detected by the sensor 52 (hereinafter referred to as "reference tension") of the tension measuring part 5 is compared, in the processor 7, with a corresponding value on a tension pattern relative to the time passage preset in the storage 10 by taking an accumulated number of revolutions of the measuring roller 42 into account. If there is any difference therebetween, signals are generated from the processor 7 to the electromagnetic brake 45 and the motor 44 as well as the yarn speed setter 81 through lines C1, C2, and C3, respectively, so that the reference winding tension is matched with the preset tension pattern. Thus, warp beams having identical diameters are always obtained, whereby the inter-beam diameter difference is eliminated. Of course, the intra-beam diameter difference is also avoidable by the provision of the local tension measuring part 5 and the reed adjusting part 2, as described before in relation to FIG. 1.

EXAMPLE 600 ends of 100 denier diacetate filament yarns were wound to form a warp beam at a rate of 600 m/min by utilizing a warper provided with the device of FIG. 1 according to the present invention. Tension meters having a detecting range of from 0 to 50 grams (gr) were adopted as the sensors 51, 52, and 53, engaged with the leftmost warp, the 300th warp, and the rightmost warp, respectively. The measured values were directed therefrom as voltages in a range from 5 to 20 mV to the converter 54, for conversion to a digital value, then input to the processor 7.

Measurement was carried out sequentially ten times per second in each sensor, and the moving average of the ten data was adopted as the measured tension by taking the possible tension variance caused by eccentricity of the beam into account.

In a preliminary test, when a diameter of the selvage portion was 2 mm larger than that of the middle portion, the tension difference between the sensors 52 and one of 51 and 53 was 12 gr. On the contrary, when a diameter of the selvage portion was 2 mm smaller than that of the middle portion, the tension difference was −5 gr. By reed control in accordance with a control limit of from −3 gr tp 10 gr, the intra-beam diameter difference was suppressed to within 2 mm.

We claim:

1. A method for forming a warp beam of uniform diameter in a warper, comprising feeding warp yarns from a source by means for positively delivering said warp yarns to a driven warp beam, all of which have the same speed and guiding said warp yarns by a reed to the warp beam, comprising the steps of:

continuously measuring at a location between the positive feeding means and the reed a local winding tension of said positively delivered warp yarns at a plurality of portions of a warp sheet to be wound on said warp beam, including opposite side portions thereof;

determining an intrabeam diameter difference from said measured local winding tension values;

generating a control signal as a function of said difference; and automatically adjusting a geometric parameter of said reed in accordance with said control signal to improve the warp yarn distribution on said beam and compensate for the intrabeam diameter difference on said beam.

2. The method of claim 1 wherein said continuous measuring step comprises the step of engaging said warp yarns with tension meters.

3. A method defined by claim 1, further comprising the steps of:

storing a time dependent tension pattern;

performing said step of continuously measuring a local winding tension for a plurality of said warp sheets;

comparing a measured reference winding tension at a middle portion of each of said warp sheets with said stored tension pattern and determining a second difference therebetween; and adjusting the positive feeding means and the driven warp beam for each of said warp sheets in such a way as to eliminate said second difference, whereby an inter-beam diameter difference among the warp beams is eliminated.

4. A method defined by claim 1, wherein the local winding tension is measured at a middle portion of the warp sheet and at opposite side portions, and wherein said intra-beam diameter difference is determined using a value obtained from the middle portion as a reference value.

5. A method defined by claim 4, further comprising the steps of:

storing a time dependent tension pattern;

performing said step of continuously measuring a local winding tension for a plurality of said warp sheets;

comparing said measured reference winding tension at a middle portion of each warp sheets with said stored tension pattern and determining a second difference therebetween;

adjusting the positive feeding means and the driven warp beam for each of said warp sheets in such a way as to eliminate said second difference, whereby an inter-beam diameter difference among the warp beams is eliminated.

* * * * *